US005685481A

United States Patent [19]

Murphy et al.

[11] Patent Number: 5,685,481

[45] Date of Patent: Nov. 11, 1997

[54] TRIP-FREE HIGH LIMIT CONTROL

[75] Inventors: Mark A. Murphy, Edmonds, Wash.; John W. Hynes, Franklin, Tenn.

[73] Assignee: Apcom, Inc., Franklin, Tenn.

[21] Appl. No.: 584,833

[22] Filed: Jan. 11, 1996

[51] Int. Cl.[6] ..... F23N 5/24

[52] U.S. Cl. ..... 236/21 B; 236/48 R; 337/333; 337/365; 337/367

[58] Field of Search ..... 236/21 B, 48 R, 236/101 E; 337/298, 333, 342, 365, 367, 388, 390

[56] References Cited

U.S. PATENT DOCUMENTS

| | | | |
|---|---|---|---|
| 2,839,638 | 6/1958 | Epstein | 337/367 |
| 3,157,768 | 11/1964 | Ladd et al. | 337/342 |
| 3,258,567 | 6/1966 | Colavecchio | 337/342 |
| 4,048,611 | 9/1977 | Kuczynski et al. | 337/365 |
| 4,403,206 | 9/1983 | Anderson | 337/367 |

*Primary Examiner*—William E. Tapolcai
*Attorney, Agent, or Firm*—Paul R. Puerner

[57] ABSTRACT

A trip-free high limit control for a water heater having a source of heat to heat the water. A switch arm is mounted in a control housing for movement in the housing. The switch arm has a first contact portion at one end thereof. A second stationary contact is mounted in the housing. The contact portion on the switch arm is movable relative to the stationary contact between closed and open positions to control the energization and de-energization of the source of heat for the water heater. A bi-metallic snap disk is mounted in the housing and is movable with snap action between first and second positions of stability at a predetermined overheat temperature. A switch arm actuating plunger is mounted in the housing for movement by the snap disk to open the switch contacts at a predetermined overheat temperature. A reset mechanism is provided which includes a reset spring mounted in the housing in operable engagement with the plunger. The spring is calibrated to provide a predetermined force on the plunger relative to a predetermined compression travel force exerted on the spring. The reset mechanism further includes a reset button in operable engagement with the reset spring. The housing has a stop surface therein to limit travel of the reset button. Such limited travel of the reset button will limit the force applied to the plunger by the compression of the spring which, in turn, will limit the reset force applied to the bi-metallic snap disk. The reset mechanism will thus operate to produce insufficient force on the bi-metallic snap disk until a predetermined safe operating temperature is sensed by the bi-metallic snap disk. As a result, the operation of the water heater cannot be resumed after the bi-metallic disk is snapped at the overheat temperature until a safe operating condition is restored in the water heater.

11 Claims, 2 Drawing Sheets

TRIP-FREE HIGH LIMIT CONTROL

BACKGROUND OF THE INVENTION

This invention relates generally to temperature regulating equipment for an appliance such as a water heater. More particularly, this invention relates to a "trip-free" high limit control for the appliance.

This control switch is a double pole-double break, single throw contact system. It is a non-adjustable, single setpoint, high temperature limit switch used as a safety device to disconnect power to electrical storage water heaters when maximum temperature limit has been exceeded.

Underwriters Laboratories, Inc. regulations applicable to the design and operation of a high limit control switch are as follows:

11. Reset Mechanism—Limiting Control 11.1 A control shall not reset or be resettable manually or otherwise to that operation of the controlled appliance can be resumed until after a safe operating condition is restored. For example, pressure or temperature returned to value at or below control set point.

11.3 A manually reset device shall be trip-free; that is, the automatic tripping shall be independent of the manipulation or position of the reset button, handle, lever, or the like.

The object of this invention is to provide a "trip-free" high limit control which complies with the applicable Underwriters Laboratories, Inc. regulations. A further object is to provide such a control that is accurate, reliable and is of a relatively simple design.

SUMMARY OF THE INVENTION

A trip-free high limit control including a housing, a switch arm mounted for movement in the housing and having a first contact portion at one end thereof. A second stationary contact is mounted in the housing. The contact portion of the switch arm is movable relative to the stationary contact between open and closed positions to control an electric circuit. A bi-metallic snap disk is mounted in the housing and movable with snap action between first and second positions of stability. The first and second contacts are in the closed position when the bi-metallic disk is in its first position of stability. The first and second contacts are in an open position when said bi-metallic disk is in its second position of stability. The bi-metallic disk is designed to open the contacts at a predetermined unsafe temperature. A switch arm actuating plunger is provided which is movable by the snap disk to open the switch contacts at a predetermined temperature. A manual reset mechanism for the switch includes a reset spring and a reset button. The reset mechanism has a trip-free operating characteristic provided by a balance between the travel of the reset button, the force characteristics of the reset spring and the thermal characteristics of the bi-metallic snap disk. Became of the balance, depression of the reset button produces insufficient force to cause the bi-metallic disk to snap from its second position to its first position until a predetermined safe operating temperature is achieved to allow the reset mechanism to overcome the force of the bi-metallic snap disk. Prior methods to create a trip-free device involve measurement and grinding techniques that create a mechanical displacement limit to the movement of the contacts. The present invention provides greater accuracy and reduced cost.

DESCRIPTION OF THE PREFERRED EMBODIMENT

Figure 1:
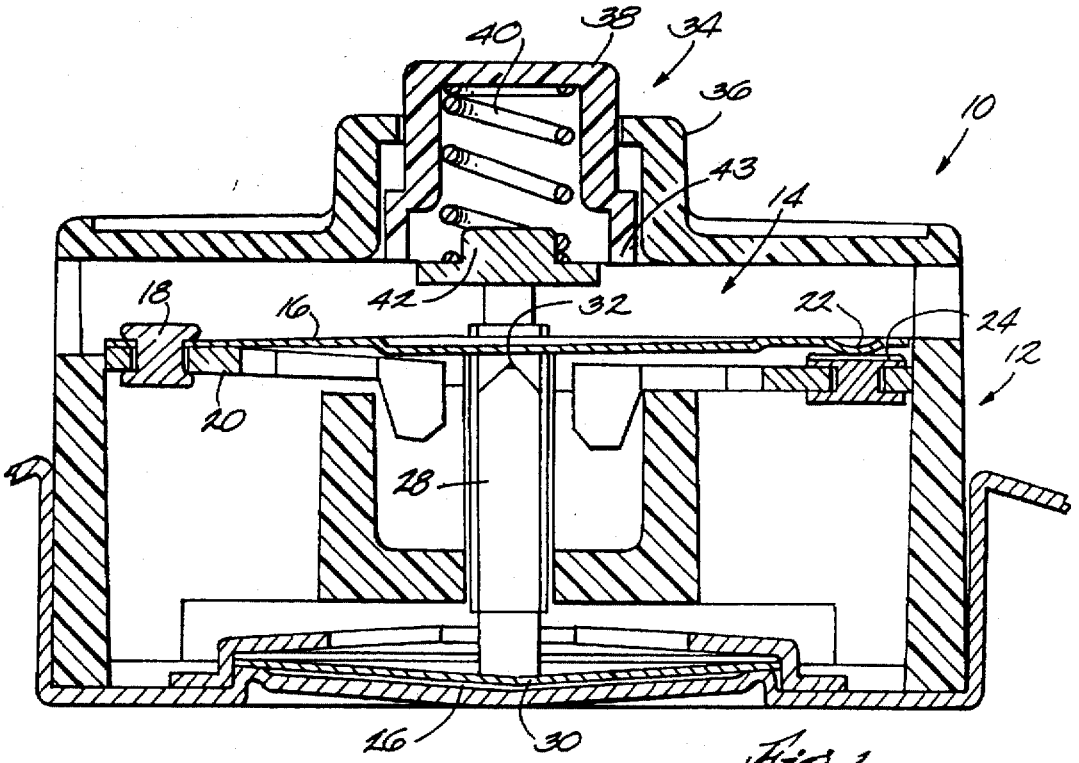
FIG. 1 is a side elevation view of the switch mechanism shown in FIG. 2 with the switch mechanism in its reset (cooled down) condition.
Figure 2:
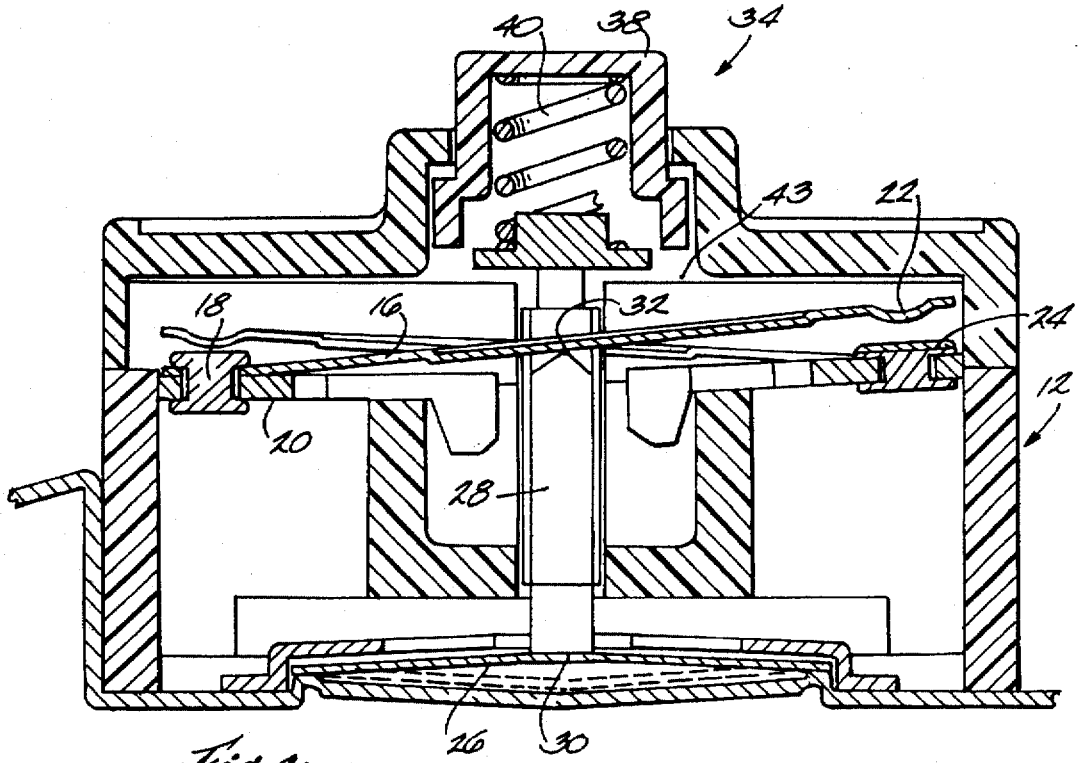
FIG. 2 is a side elevation view of a high limit control mechanism which embodies the trip-free reset mechanism of the present invention with the switch mechanism in its tripped (hot) condition.

The high limit control 10 shown in FIGS. 1 and 2 is comprised of a housing 12 in which a thermostatic switch mechanism 14 is mounted.

Mechanism 14 is comprised of a switch arm 16 mounted at one end 18 on a stationary support 20. The other free end 22 of arm 16 is adapted for movement into and out of contact with a stationary contact member 24.

The switch mechanism 14 further includes a bi-metallic snap disk member 26 and a switch actuating plunging member 28 mounted for vertical movement in housing 12 and positioned with its lower end 30 in contact with the center of disk 26.

The center of switch arm 16 is positioned opposite a shoulder 32 on plunger 28.

A reset mechanism 34 is mounted in a cover member 36 of housing 12. Reset mechanism 34 is comprised of three (3) separate parts, namely, a reset button 38, a reset spring 40 and a reset cap member 42. Reset button 38 is mounted for vertical movement in cover 36, spring 40 is mounted inside reset button 38 and cap member 42 is positioned between the bottom end of spring 40 and the top end of plunger 28. A stop surface 43 in housing 12 limits the vertical travel of reset button 38.

Figure 5:
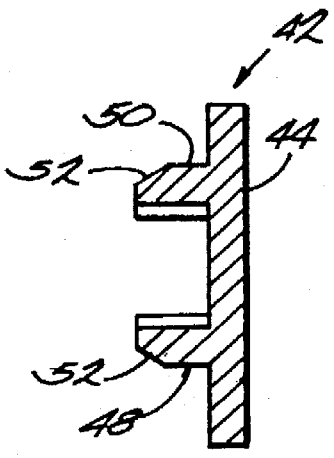
FIG. 5 is a sectional view taken along line 5—5 of FIG. 3.
Figure 4:
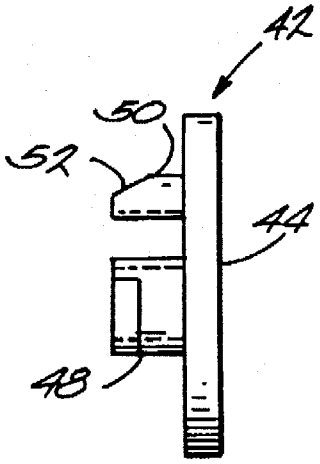
FIG. 4 is a side elevation of the reset cap shown in FIG. 3.
Figure 3:
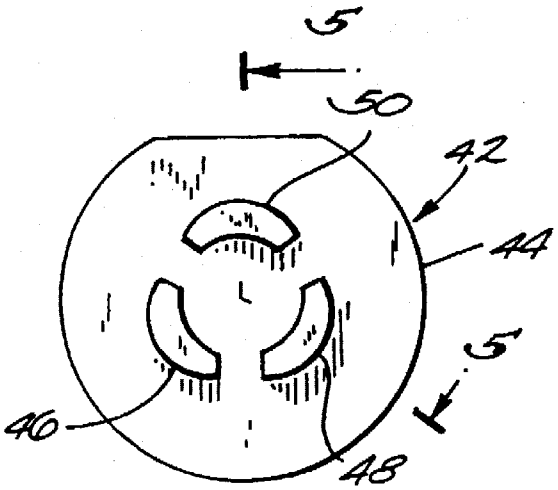
FIG. 3 is a top plan view of the reset cap which is a component of the reset mechanism of the present invention.

As shown in FIGS. 3, 4 and 5, cap member 42 has a base portion 44 and three upstanding ear portions 46, 48 and 50 on the base portion. Each ear portion has a beveled edge 52. In assembled position, the ear portions 46, 48 and 50 are snapped into the bottom interior portion of spring 40. Beveled edges 52 facilitate the assembly of the cap 42 and the spring 40.

OPERATION

While the high limit control of the present invention may have several applications, it will be described herein as a high limit control for a domestic water heater wherein water is heated in an enclosed tank by a suitable heat source such as an electric heating element 15. The water heater, water heater tank and electric heating clement are of conventional design and thus not described in detail herein.

Referring to FIG. 1, the dual switch mechanism 14 is in its normal operating position, i.e., with the switch contacts 22, 24 closed. In such position, the water in the heater tank is maintained with a range of temperatures controlled by a thermostatic control device of conventional design (not shown). In a typical example, the water in the tank is maintained within a range of 70° F. to 170° F.

If for any reason the temperature in the tank should increase beyond the preset upper limit (i.e., 190° F. in the present example), bi-metallic snap disk 26 will snap from the position shown in FIG. 1 to the position shown in FIG. 2. Such snap action of disk 26 will cause plunger 28 to move vertically upwardly which, in turn, will cause switch arm 16 to be snapped from its closed position shown in FIG. 1 to its open position shown in FIG. 2. Contact between end 22 of arm 16 and contact 24 will thus be broken to thereby de-energize the heat source for the water heater. Overheating of the water heater with possible unsafe consequences is thus prevented.

The next step in the operation of high limit control 10 is to "reset" the switch mechanism. As explained previously, Underwriters Laboratories, Inc. regulations applicable to the design and operation of a high limit control switch of this type are as follows:

11.1 A control shall not reset or be resettable manually or otherwise to that operation of the controlled appliance can be resumed until after a safe operating condition is restored. For example, pressure or temperature returned to value at or below control set point.

11.3 A manually reset device shall be trip-free; that is, the automatic tripping shall be independent of the manipulation or position of the reset button, handle, lever, or the like.

In the present invention, the UL requirements are met by the reset mechanism 34. More specifically, the trip-free requirement of the reset mechanism 34 is provided by an accurate balance between the travel of the reset button 38, the force characteristics of the reset spring 40 and the force resulting from the thermal characteristics of the bi-metallic snap disk 26.

When the reset button 38 is depressed, the force exerted on disk 26 by plunger 28 will be a function of the button travel and the built-in force characteristics of reset spring 40. The travel of reset button 38 is limited by stop surface 43. For example, in one embodiment, the spring 40 is manufactured to exert a force of 6 to 8 pounds when the spring is compressed a given distance. A spring 40 with the above characteristics is used in combination with a snap disk 26 that will snap back from its FIG. 2 position to its FIG. 1 position by a force of approximately 7 pounds when the disk is at a safe reset temperature.

It will be appreciated from the foregoing that if the reset button 38 is depressed before the disk 26 cools down to a safe reset temperature, the force exerted on the disk will be insufficient to reset the disk. The trip-free requirement is thereby produced by the balance between the reset button travel, the force characteristics of the reset spring and the thermal characteristics of the bi-metallic disk. With the proper balance of the components of the reset mechanism 34, the operation of the water heater cannot be resumed until after a safe operating condition is restored.

While the invention has been herein shown and described in what is presently conceived to be the most practical and preferred embodiment, it will be obvious to one or ordinary skill in the art that modifications may be made thereof within the scope of the invention, which scope is not to be limited except by the appended claims.

We claim:

1. A trip-free high, limit control comprising:

(a) a housing;

(b) a switch arm mounted for movement in said housing and having a first contact portion thereon;

(c) a second stationary contact mounted in said housing, said contact portion of said switch arm movable relative to said stationary contact between open and closed positions to control an electric circuit;

(d) a bi-metallic snap disk mounted in said housing and movable with snap action between first and second positions of stability, said first and second contacts in said closed position in said first position of stability and said first and second contacts in said open position in said second position of stability;

(e) a switch arm actuating plunger adapted for movement by said snap disk;

(f) a reset mechanism for the thermostatic switch comprising:

(i) a reset spring mounted in said housing in operable engagement with said plunger;

(ii) a reset button mounted in said housing in operable engagement with said reset spring;

(g) said reset mechanism having a trip-free operating characteristic provided by a balance between the travel of said reset button, the force characteristics of said reset spring and the thermal characteristics of said bi-metallic snap disk wherein depression of said reset button produces insufficient force to cause said bi-metallic disk to snap from its second position to its first position until a predetermined operating temperature is sensed by said bi-metallic snap disk.

2. A trip-free high limit control according to claim 1 in which said reset mechanism further includes a reset cap member positioned between the end of said reset spring and the top of said actuating plunger.

3. A trip-free high limit control according to claim 2 in which said reset cap member has a bottom flange portion and a plurality of upstanding ear portions on said flange portion with said ear portions positioned inside the lower end of said reset spring and with said flange portion in contact with the top of said actuating plunger.

4. A trip-free high limit control according to claim 3 in which said ear portions on said flange portion of said cap member are in frictional engagement with said reset spring.

5. A trip-free high limit control for a water heater having a source of heat to heat the water;

(a) a switch housing;

(b) a switch arm mounted for movement in said housing and having a first contact portion thereon;

(c) a second stationary contact mounted in said housing, said contact portion of said switch arm movable relative to said stationary contact between open and closed positions to control the energization and de-energization of the source of heat for the water heater;

(d) a bi-metallic snap disk mounted in said housing and movable with snap action between first and second positions of stability, said first and second contacts in said closed position in said first position of stability and said first and second contacts in said open position in said second position of stability;

(e) a switch arm actuating plunger adapted for movement by said snap disk to open said switch contacts at a predetermined temperature;

(f) a reset mechanism for the thermostatic switch comprising:

(i) a reset spring mounted in said housing in operable engagement with said plunger, said spring calibrated to provide a predetermined force on said plunger relative to a predetermined compression travel force exerted on the spring;

(ii) a reset button mounted in said housing in operable engagement with said reset spring, said housing having a stop surface therein to limit travel of said reset button to limit the force applied to said plunger by said spring which in turn will limit the reset force applied to said bi-metallic snap disks by said plunger.

6. A trip-free high limit control according to claim 5 in which said reset mechanism further includes a reset cap member positioned between the end of said reset spring and the top of said actuating plunger.

7. A trip-free high limit control according to claim 6 in which said reset cap member has a bottom flange portion and a plurality of upstanding ear portions on said flange portion with said ear portions positioned inside the lower end of said reset spring and with said flange portion in contact with the top of said actuating plunger.

8. A trip-free high limit control according to claim 7 in which said ear portions on said flange portion of said cap member are in frictional engagement with said reset spring.

9. A trip-free high limit control according to claim 5 in which there is a balance between the travel of said reset button, the force characteristics of said reset spring and the thermal characteristics of said bi-metallic snap disk wherein depression of said reset button produces insufficient force to cause the bi-metallic disk to snap from its second position to its first position until a predetermined operating temperature is sensed by said bi-metallic snap disk.

10. A water heater including a tank containing water;

(a) a source of heat for heating the water in the tank;

(b) a trip-free high limit control for the water heater comprising:

(i) a housing;

(ii) a switch arm mounted for movement in said housing and having a first contact portion thereon;

(iii) a second stationary contact mounted in said housing, said contact portion of said switch arm movable relative to said stationary contact between open and closed positions to control an electric circuit which, in turn, controls the energization and de-energization of the source of heat for heating the water in the tank;

(iv) a bi-metallic snap disk mounted in said housing and movable with snap action between first and second positions of stability, said first and second contacts in said closed position in said first position of stability and said first and second contacts in said open position in said second position of stability;

(v) a switch arm actuating plunger adapted for movement by said snap disk;

(vi) a reset mechanism for the thermostatic switch comprising:

1) a reset spring mounted in said housing in operable engagement with said plunger;

2) a reset button mounted in said housing in operable engagement with said reset spring;

(vii) said reset mechanism having a trip-free operating characteristic provided by a balance between the travel of said reset button, the force characteristics of said reset spring and the thermal characteristics of said bi-metallic snap disk wherein depression of said reset button produces insufficient force to cause said bi-metallic disk to snap from its second position to its first position until a predetermined safe operating temperature is sensed by said bi-metallic snap disk.

11. A water heater including a tank containing water;

(a) a source of heat for heating the water in the tank;

(b) a trip-free high limit control for the water heater comprising:

(i) a switch housing;

(ii) a switch arm mounted for movement in said housing and having a first contact portion thereon;

(iii) a second stationary contact mounted in said housing said contact portion of said switch arm movable relative to said stationary contact between open and closed positions to control the energization and de-energization of the source of heat for the water heater;

(iv) a bi-metallic snap disk mounted in said housing and movable with snap action between first and second positions of stability, said first and second contacts in said closed position in said first position of stability and said first and second contacts in said open position in said second position of stability;

(v) a switch arm actuating plunger adapted for movement by said snap disk to open said switch contacts at a predetermined temperature;

(vi) a reset mechanism for the thermostatic switch comprising:

1) a reset spring mounted in said housing in operable engagement with said plunger, said spring calibrated to provide a predetermined force on said plunger relative to a predetermined compression travel force exerted on the spring;

2) a reset button mounted in said housing in operable engagement with said reset spring, said housing having a stop surface therein to limit travel of said reset button to limit the force applied to said plunger by said spring which in turn will limit the reset force applied to said bi-metallic snap disks by said plunger.

* * * * *